US008863763B1

(12) United States Patent
Chen et al.

(10) Patent No.: US 8,863,763 B1
(45) Date of Patent: Oct. 21, 2014

(54) SONICATION CLEANING WITH A PARTICLE COUNTER

(75) Inventors: Chaoyuan Chen, San Jose, CA (US); Rhownica A. Lund, Fremont, CA (US); Atul K. Trivedi, Milpitas, CA (US)

(73) Assignee: WD Media, LLC, San Jose, CA (US)

( * ) Notice: Subject to any disclaimer, the term of this patent is extended or adjusted under 35 U.S.C. 154(b) by 1216 days.

(21) Appl. No.: 12/473,227

(22) Filed: May 27, 2009

(51) Int. Cl.
*B08B 3/04* (2006.01)

(52) U.S. Cl.
USPC ..... 134/111; 134/113; 134/902

(58) Field of Classification Search
USPC ..... 134/56 R, 111, 113, 902
See application file for complete search history.

(56) References Cited

U.S. PATENT DOCUMENTS

| | | | | |
|---|---|---|---|---|
| 3,276,458 | A * | 10/1966 | Davis et al. | 134/57 R |
| 4,181,009 | A | 1/1980 | Williamson | |
| 4,711,256 | A * | 12/1987 | Kaiser | 134/25.4 |
| 4,779,451 | A * | 10/1988 | Ezawa et al. | 73/53.01 |
| 4,865,060 | A | 9/1989 | Shibano | |
| 4,907,611 | A | 3/1990 | Shibano | |
| 5,089,144 | A * | 2/1992 | Ozkahyaoglu et al. | 210/767 |
| 5,286,657 | A | 2/1994 | Bran | |
| 5,301,701 | A | 4/1994 | Nafziger | |
| 5,482,068 | A | 1/1996 | Kitahara et al. | |
| 5,647,386 | A * | 7/1997 | Kaiser | 134/113 |
| 5,849,104 | A | 12/1998 | Mohindra et al. | |
| 5,868,855 | A | 2/1999 | Fukazawa et al. | |
| 5,873,947 | A | 2/1999 | Mohindra et al. | |
| 5,931,173 | A * | 8/1999 | Schiele | 134/57 R |
| 5,988,189 | A | 11/1999 | Mohindra et al. | |
| 6,106,590 | A | 8/2000 | Ueno et al. | |
| 6,167,891 | B1 | 1/2001 | Kudelka et al. | |
| 6,172,376 | B1 | 1/2001 | Xu et al. | |
| 6,357,458 | B2 | 3/2002 | Tanaka et al. | |
| 6,402,818 | B1 | 6/2002 | Sengupta | |
| 7,004,016 | B1 * | 2/2006 | Puskas | 73/64.53 |
| 7,311,847 | B2 | 12/2007 | Kashkoush | |
| 7,976,718 | B2 * | 7/2011 | Kashkoush et al. | 216/93 |
| 2002/0142617 | A1 | 10/2002 | Stanton | |
| 2003/0159713 | A1 | 8/2003 | Park et al. | |
| 2004/0016442 | A1 | 1/2004 | Cawlfield | |
| 2004/0035449 | A1 * | 2/2004 | Nam | 134/56 R |
| 2004/0238005 | A1 * | 12/2004 | Takayama | 134/18 |
| 2007/0028437 | A1 | 2/2007 | Kimura et al. | |

(Continued)

FOREIGN PATENT DOCUMENTS

| | | |
|---|---|---|
| JP | 02-157077 | 6/1990 |
| JP | 2001-009395 | 1/2001 |

(Continued)

OTHER PUBLICATIONS

U.S. Appl. No. 12/473,223, filed May 27, 2009, 33 pages.

(Continued)

*Primary Examiner* — Michael Barr
*Assistant Examiner* — Jason Riggleman

(57) ABSTRACT

A sonication cleaning tank containing a liquid is monitored. A first opacity count is generated indicative of contaminants and/or bubbles in the liquid. At least some of the liquid is filtered to remove contaminants from the liquid, and a second opacity count indicative of contaminants and/or bubbles in the filtered liquid is generated. Based at least in part on the first and second opacity counts, a contaminant count corresponding to an estimated number of contaminants in the liquid is then determined.

26 Claims, 11 Drawing Sheets

(56) References Cited

U.S. PATENT DOCUMENTS

| | | | |
|---|---|---|---|
| 2007/0267040 | A1 | 11/2007 | Watanabe et al. |
| 2007/0289394 | A1 | 12/2007 | Yao et al. |
| 2009/0088909 | A1 | 4/2009 | Yokoi |

FOREIGN PATENT DOCUMENTS

| | | | |
|---|---|---|---|
| JP | 2007-326088 | * | 12/2001 |
| JP | 2007-225335 | * | 9/2007 |
| KR | 2007079695 | * | 8/2007 |

OTHER PUBLICATIONS

Office Action dated Apr. 11, 2012 from U.S. Appl. No. 12/473,223, 8 pages.

Office Action dated Sep. 5, 2012 from U.S. Appl. No. 12/473,223, 8 pages.

Notice of Allowance dated Nov 30, 2012 from U.S. Appl. No. 12/473,223, 11 pages.

* cited by examiner

SONICATION CLEANING WITH A PARTICLE COUNTER

BACKGROUND

During magnetic disk manufacturing, disk surfaces are exposed to various sources of contamination. For example, different gases, chemicals, deposition materials and dust may end up as contaminants. These contaminants may be deposited on the disk surfaces in particulate or other forms and must then be removed during one or more stages of the manufacturing process.

Contaminants are typically removed using a combination of sonication and rinsing techniques. A disk may first be submerged in a sonication cleaning tank to loosen and remove contaminants, and then moved to a rinsing tank where the remaining contaminants may be carried away from the disk surfaces. Conventionally, there is no real-time mechanism for measuring the efficiency of these cleaning processes. Thus, there may be relatively little feedback for an operator to determine that the disks are not being cleaned effectively or to detect failure in one or more components of the cleaning apparatuses.

DETAILED DESCRIPTION

Figure 1:
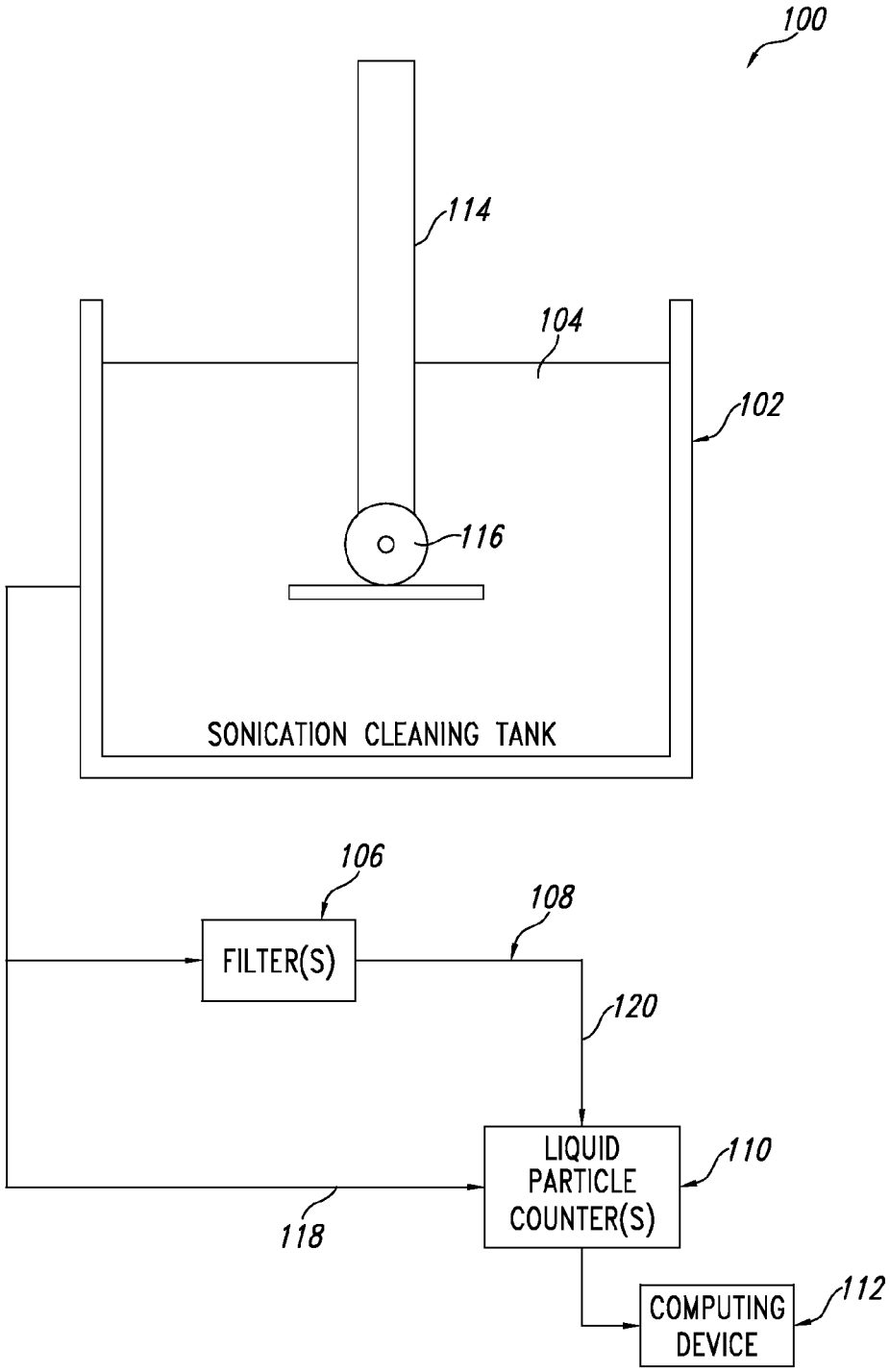
FIG. 1 is a schematic view illustrating an example sonication cleaning system including one or more filters and liquid particle counters, according to one embodiment.

Referring to FIG. 1, an example sonication cleaning system 100 is illustrated, according to one embodiment. The sonication cleaning system 100 includes a sonication cleaning tank 102 configured to contain a liquid 104, at least one filter 106 fluidly coupled to the sonication cleaning tank 102 and configured to remove contaminants from at least some of the liquid 104 to produce filtered liquid 108, and at least one liquid particle counter 110 fluidly coupled to the sonication cleaning tank 102. The at least one liquid particle counter 110 may be configured to generate a first opacity count indicative of contaminants and/or bubbles in the liquid 104, and may be further configured to generate a second opacity count indicative of contaminants and/or bubbles in the filtered liquid 108. A computing device 112 is coupled to the at least one liquid particle counter 110 and configured to determine a contaminant count corresponding to an estimated number of contaminants in the liquid 104 based at least in part on the first and second opacity counts.

The sonication cleaning system 100 may be used in a variety of manufacturing and/or cleaning environments. In one embodiment, the sonication cleaning system 100 includes a disk holder 114 configured to hold a disk 116 within the liquid 104 during a cleaning operation. The disk 116 may comprise, for example, a magnetic disk, and the sonication cleaning system 100 may be used to perform a post-sputter cleaning of the disk 116. In other embodiments, the methods and systems described herein may be used during cleaning operations performed on other workpieces (e.g., industrial equipment, lenses, or other electronic equipment).

The sonication cleaning tank 102 may comprise any of a variety of cleaning tanks employing sonication. In one embodiment, the sonication cleaning tank 102 may comprise a cross flow cleaning tank (illustrated in greater detail in FIG. 4). In such an embodiment, the overall flow of the liquid 104 through the sonication cleaning tank 102 may be generally from right to left in FIG. 1, and this flow may be generally perpendicular to the direction of propagation of acoustic waves generated within the sonication cleaning tank 102. In another embodiment, the sonication cleaning tank 102 may comprise an overflow sonication cleaning tank (illustrated and discussed in greater detail with reference to FIG. 3). In such an embodiment, the overall flow of the liquid through the sonication cleaning tank may be generally parallel to the direction of propagation of the acoustic waves. Other configurations for the sonication cleaning tank 102 may also be used.

A sonication generator (not shown) may be positioned proximate the sonication cleaning tank 104 in order to generate sonication (i.e., acoustic waves) through the liquid 104. The sonication generator may generate megasonication, ultrasonication (a lower frequency sonication than megasonication), or acoustic waves at other frequencies. Ultrasonic cleaning may use lower frequencies and thereby produce more random cavitations, while megasonication may use higher frequencies and thereby produce more controlled cavitations.

The sonication cleaning tank 102 may further include one or more ingress and egress ports, which serve to direct the liquid 104 into and out from the sonication cleaning tank 102. The sonication cleaning tank 102 may further include at least one opening at the top through which workpieces may be lowered into the liquid 104. In one embodiment, as illustrated, the sonication cleaning tank 102 does not include a top wall. The sonication cleaning tank 102 may also have any suitable shape (e.g., rectilinear or bowl-shaped).

In one embodiment, the liquid 104 flowing through the sonication cleaning tank 102 principally comprises deionized water. However, in other embodiments, the liquid 104 may comprise any of a variety of solvents and solutes. For example, the liquid 104 may comprise alcohols, detergents and/or wetting agents. In some embodiments, the liquid 104 may include some undissolved solids. The type of solution may depend upon the type of workpiece being cleaned as well as upon the cleaning operation performed using the sonication cleaning system 100.

The at least one filter 106 fluidly coupled to the sonication cleaning tank 102 may be configured to filter a variety of different contaminants in order to produce the filtered liquid 108. In one embodiment, the at least one filter 106 may comprise at least one of an ionic chemical filter, a carbon filter, a particle filter or some other type of filter. The at least one filter 106 may further comprise a system of similar or different filters connected in series or in parallel. Each filter in this system of filters may be directly fluidly coupled to the at least one liquid particle counter 110, such that the at least one liquid particle counter 110 may generate opacity counts corresponding to each of these filters. However, in other embodiments, the at least one liquid particle counter 110 may be fluidly coupled only to an output of the entire system of filters, such that only a single opacity count indicative of contaminants and/or bubbles in the filtered liquid 108 may be generated.

In one embodiment, the at least one filter 106 may be positioned between the egress and ingress ports of the sonication cleaning tank 102, and the filtered liquid 108 may thus flow back through the sonication cleaning tank 102. In other embodiments, the at least one filter 106 is not used to filter the liquid 104, and the filtered liquid 108 is not reintroduced to the sonication cleaning tank 102.

In one embodiment, the at least one liquid particle counter 110 is fluidly coupled to the sonication cleaning tank 102 via a first fluid path 118 and is configured to generate a first opacity count indicative of contaminants and/or bubbles in the liquid 104. The at least one liquid particle counter 110 may include a light sensor configured to generate signals indicative of the first opacity count. For example, at least some liquid may be drawn from the sonication cleaning tank 102 into the at least one liquid particle counter 110 via the first fluid path 118, and the light sensor may comprise a CCD array configured to detect contaminants and bubbles that block or scatter light passing through the drawn liquid. In another embodiment, the at least one liquid particle counter 110 may operate by a reflectance optical measurement technique and may be coupled to a wall of the sonication cleaning tank 102. In still another embodiment, the at least one liquid particle counter 110 may be disposed within the sonication cleaning tank 102 itself. Many liquid particle counters are unable to differentiate between contaminants and bubbles, and thus the opacity count generated by the at least one liquid particle counter 110 may be indicative of both contaminants and bubbles.

The at least one liquid particle counter 110 may be further configured to generate a second opacity count indicative of contaminants and/or bubbles in the filtered liquid 108 from the at least one filter 106. As illustrated, the at least one liquid particle counter 110 may be fluidly coupled to the at least one filter 106 via a second fluid path 120. In some embodiments, a single liquid particle counter 110 may be fluidly coupled to both the sonication cleaning tank 102 and the at least one filter 106 and may be configured to generate both the first and second opacity counts. However, in other embodiments, the at least one liquid particle counter 110 may include a first liquid particle counter fluidly coupled to the sonication cleaning tank 102 and configured to generate the first opacity count, and a second liquid particle counter fluidly coupled to the at least one filter 106 and configured to generate the second opacity count. These different embodiments are discussed at greater length below.

The at least one liquid particle counter 110 may include a degasser (not shown in FIG. 1) positioned upstream from the light sensor to remove at least some of the bubbles before generating either of the first or second opacity counts. In such an embodiment, depending upon the degassing efficiency, the first and/or second opacity count may be more or less indicative of just contaminants in the liquid 104.

The contaminants detected by the at least one liquid particle counter 110 may include particulates, oils, and other impurities in the liquid 104. In some embodiments, the at least one liquid particle counter 110 may be configured to detect contaminants and bubbles above a certain size. For example, in one embodiment, the at least one liquid particle counter 110 may be configured to detect contaminants larger than 1.0 μm. In another embodiment, the at least one liquid particle counter 110 may be configured to detect contaminants larger than 0.5, 0.2 or 0.1 μm. In some embodiments, the contaminant size detected by the at least one liquid particle counter 110 may correspond generally to the contaminant size filtered by the at least one filter 106.

As illustrated schematically in FIG. 1, the at least one liquid particle counter 110 may be fluidly coupled at or near an egress port of the sonication cleaning tank 102. Thus, in one embodiment, the at least one liquid particle counter 110 may sample liquid 104 from the sonication cleaning tank 102 that has already flowed past the disk 116. Of course, in other embodiments, the at least one liquid particle counter 110 may be coupled to the sonication cleaning tank 102 at other locations. The at least one liquid particle counter 110 may also be configured to generate the first and second opacity counts during a cleaning operation. Thus, in one embodiment, a cleaning operation need not be halted in order to receive feedback regarding the contaminants and/or bubbles contained in the liquid 104.

The computing device 112 is communicatively coupled to the at least one liquid particle counter 110 and is configured to determine a contaminant count corresponding to an estimated number of contaminants in the liquid 104 based at least in part on the first and second opacity counts. In one embodiment, the first opacity count may be indicative of both contaminants and bubbles present in the liquid 104, while the second opacity count may be primarily indicative of the bubbles present in the liquid 104 (since the contaminants may be largely filtered out by the at least one filter 106). Thus, in one embodiment, the computing device 112 may compute the contaminant count by subtracting the second opacity count from the first opacity count. Of course, the contaminant count determined in this way may not be precisely equal to a contaminant level in the liquid 104. However, the contaminant count determined by the computing device 112 may represent a closer approximation to an absolute contaminant level than either of the opacity counts individually.

The computing device 112 may also take into account other variables when calculating the contaminant count. For example, the computing device 112 may factor in information indicative of a filtering efficiency of the at least one filter 106 in order to correct for contaminants included in the second opacity count. As another example, the computing device 112 may factor in information indicative of "natural" degassing that occurs between the sonication cleaning tank 102 and the at least one liquid particle counter 110 along the first fluid path 118 and/or the second fluid path 120.

The computing device 112 may comprise any of a variety of computing devices (e.g., a personal computer running Windows), and may include a processor operable to execute instructions and a computer-readable memory having instructions stored thereon that are executable by the processor in order to cause the processor to perform one or more acts. In one embodiment, many of the acts described herein may be orchestrated by the processor based on those instructions stored in the computer-readable memory.

As described above, the sonication cleaning system 100 may include a disk holder 114. The disk holder 114 may be movable between a raised position, wherein the disk 116 is positioned above the liquid 104, and a lowered position, wherein the disk 116 is positioned within the liquid 104. For example, an actuator (not shown) may be coupled to the disk holder 114, and the actuator may be electronically controlled in order to move the disk holder 114 between these positions. In other embodiments, the disk holder 114 need not be movable. In still other embodiments, the sonication cleaning system 100 need not include a disk holder 114, but may include another structure for holding a workpiece within the liquid 104 during a cleaning operation.

The disk 116 may comprise any of a variety of magnetic or optical disks having a substantially concentric opening defined therethrough. As used herein, the term "disk" refers to a magnetic or optical disk at any stage of manufacturing. That is, the disk 116 need not be readable or writable at the time a cleaning operation is performed using the sonication cleaning system 100. In one embodiment, the sonication cleaning system 100 may be configured to hold and clean a single disk 116. However, in other embodiments, the sonication cleaning tank 102 may accommodate a plurality of disks 116 (not shown).

Figure 2:
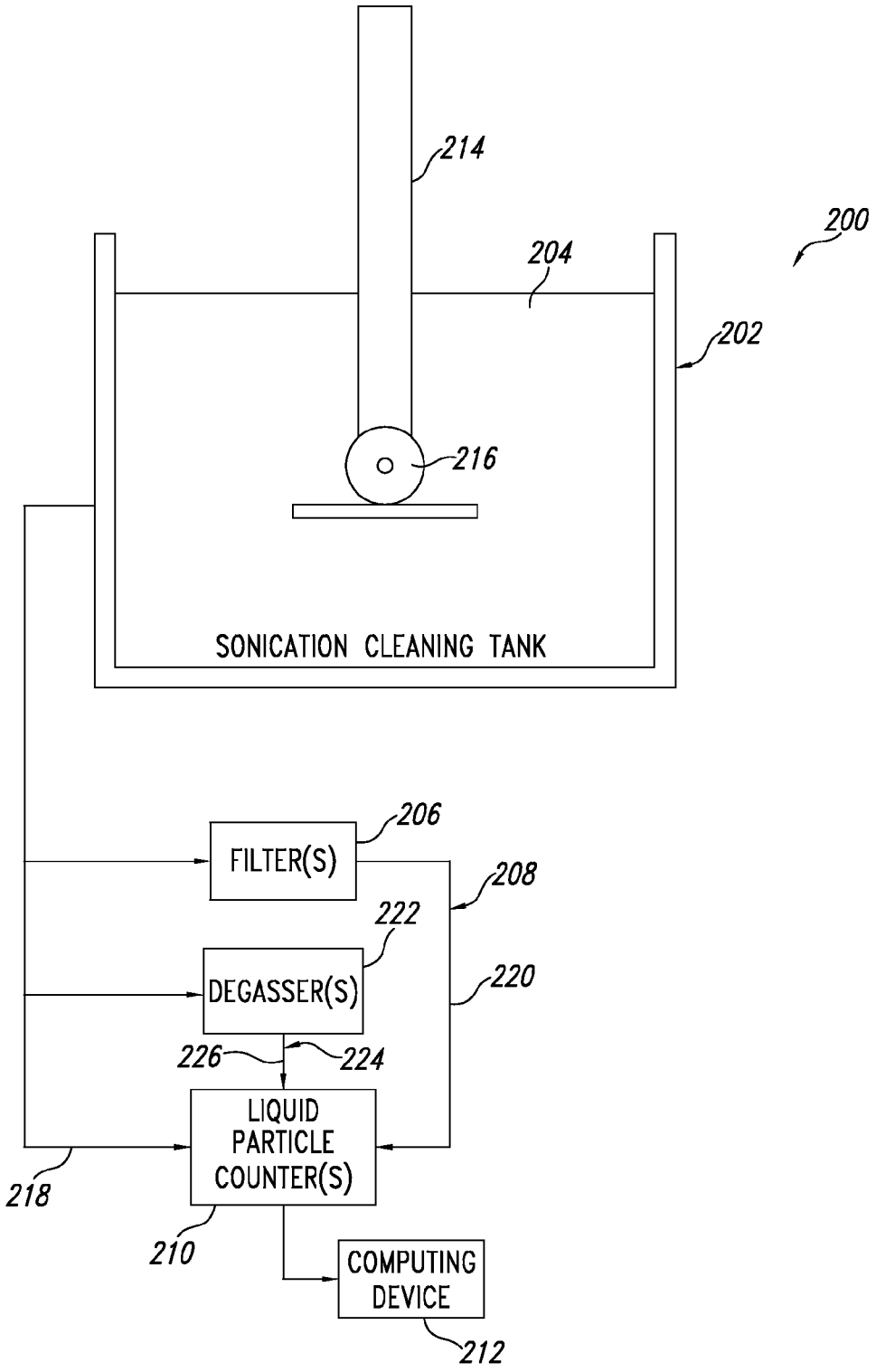
FIG. 2 is a schematic view illustrating an example sonication cleaning system including one or more filters, degassers and liquid particle counters, according to one embodiment.

FIG. 2 illustrates a sonication cleaning system 200 configured similarly to the sonication cleaning system 100, with like numerals referring to like components. Much of the description corresponding to FIG. 1 can be applied equally to the components of FIG. 2. Only the new components and different component arrangements of the sonication cleaning system 200 are discussed in greater detail below.

The sonication cleaning system 200 of FIG. 2 includes at least one degasser 222 fluidly coupled to the sonication cleaning tank 202 and configured to remove bubbles from at least some of the liquid 204 to produce degassed liquid 224. The at least one degasser 222 may comprise any of a variety of degassing structures. In one embodiment, the at least one degasser 222 comprises a plurality of small tubes with microscopic pores. A partial vacuum is generated within the tubes while the liquid 204 flows around the tubes, and thus gases can pass out of the liquid 204 through the pores into the tubes. Any of a variety of vacuum sources may be used. In one embodiment, a venturi vacuum is used in order to minimize mechanical vibrations that may be generated by other vacuum sources.

The at least one degasser 222 may comprise one or more separate degassers connected in series or in parallel. These degassers may be of the same or of different types. In one embodiment, for example, the at least one degasser 222 comprises at least two degassers connected in series. Such an arrangement may improve both a degassing efficiency as well as the transition time to achieve the optimal degassing efficiency.

In addition to the first and second opacity counts, the at least one liquid particle counter 210 may be further configured to generate a third opacity count indicative of contaminants and/or bubbles in at least some of the degassed liquid 224. As illustrated, the at least one liquid particle counter 210 may be fluidly coupled to the at least one degasser 222 via a third fluid path 226. In some embodiments, a single liquid particle counter 210 may be fluidly coupled to the sonication cleaning tank 202, the at least one filter 206 and the at least one degasser 222 and may be configured to generate the first, second and third opacity counts. However, in other embodiments, the at least one liquid particle counter 210 may include a first liquid particle counter fluidly coupled to the sonication cleaning tank 202 and configured to generate the first opacity count, a second liquid particle counter fluidly coupled to the at least one filter 206 and configured to generate the second opacity count, and a third liquid particle counter fluidly coupled to the at least one degasser 222 and configured to generate the third opacity count. These different embodiments are discussed at greater length below.

In one embodiment, a flow rate through the at least one degasser 222 may be controlled. For example, a flow rate of less than 100 milliliters per minute may be maintained through the at least one degasser 222. As illustrated, the at least one liquid particle counter 210 may be fluidly coupled to an outlet of the at least one degasser 222, and the flow rate of the at least one liquid particle counter 210 may thus be controlled in order to maintain the flow rate through the at least one degasser 222. In other embodiments, other components may be employed to control the flow rate through the at least one degasser 222. For example, the at least one degasser 222 may include its own proportional valve (not shown). By maintaining a relatively slow flow rate, the degassing efficiency of the at least one degasser 222 may be improved.

In one embodiment, the computing device 212 is further configured to determine a degassing efficiency associated with the at least one degasser 222 based at least in part on the first, second and third opacity counts. The degassing efficiency generally corresponds to the number of bubbles removed by the at least one degasser 222 divided by the total number of bubbles in the liquid 204. In one embodiment, the degassing efficiency may be equal to a numerator divided by a denominator, wherein the numerator is equal to the third opacity count subtracted from the first opacity count (yielding an approximate number of bubbles removed by the at least one degasser 222) and the denominator is equal to the second opacity count (yielding an approximate number of bubbles in the liquid 204). In other embodiments, the third opacity count may be used for other calculations as well.

The computing device 212 may also take into account other variables when calculating the degassing efficiency. For example, the computing device 212 may factor in information indicative of a filtering efficiency of the at least one filter 206 in order to correct for contaminants included in the second opacity count. As another example, the computing device 212 may factor in information indicative of "natural" degassing that occurs between the sonication cleaning tank 202 and the at least one liquid particle counter 210 along the first fluid path 218 and/or the second fluid path 220.

Figure 3:
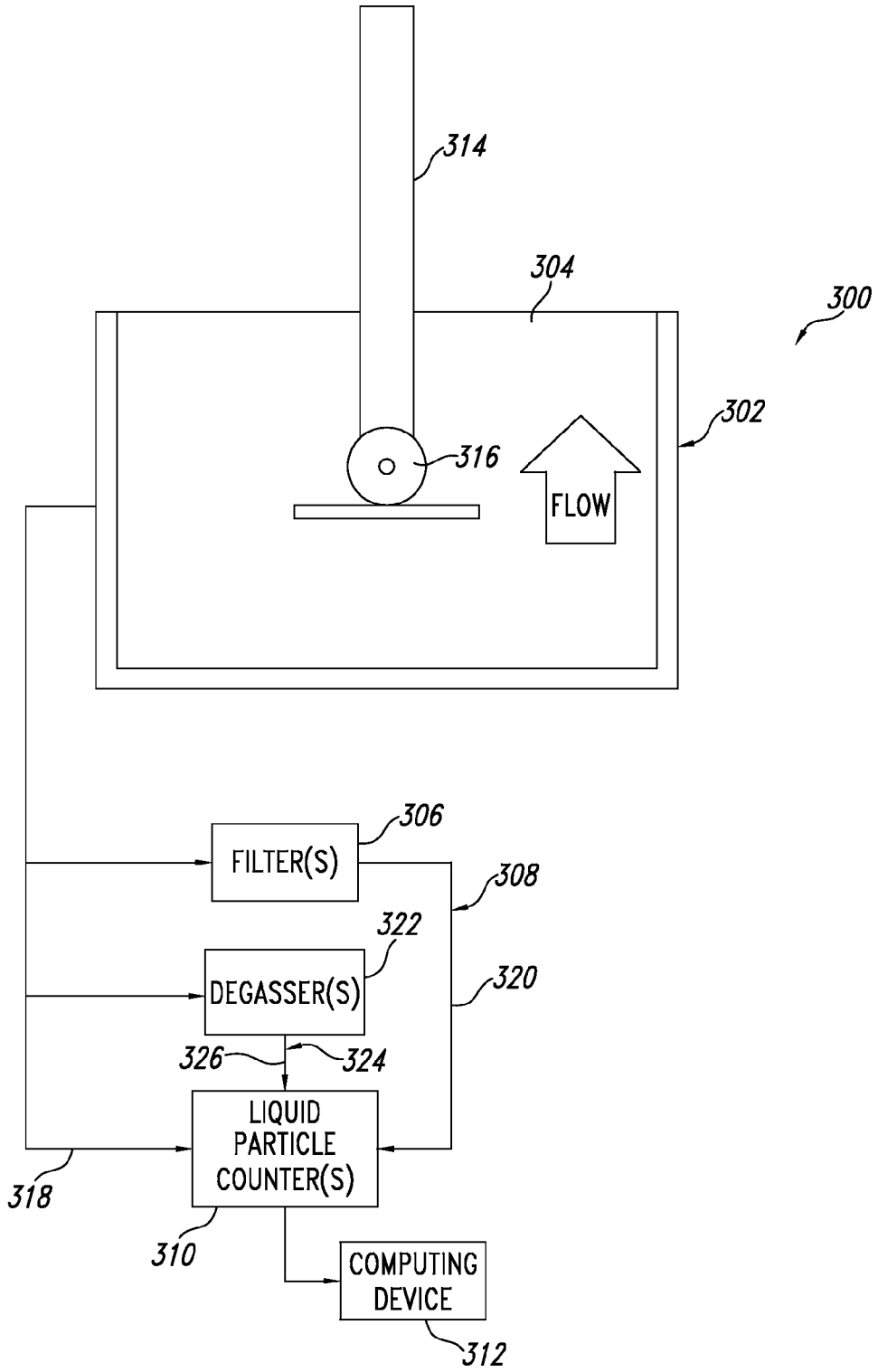
FIG. 3 is a schematic view illustrating an example sonication cleaning system including an overflow sonication cleaning tank, according to one embodiment.

FIG. 3 illustrates a sonication cleaning system 300 configured similarly to the sonication cleaning system 200, with like numerals referring to like components. Much of the description corresponding to FIGS. 1 and 2 can be applied equally to the components of FIG. 3. However, rather than employing a cross flow sonication cleaning tank, the sonication cleaning system 300 of FIG. 3 includes an overflow sonication cleaning tank 302. The sonication cleaning tank 302 may include one or more ingress ports along its bottom, and the liquid 304 generally flows up and out through the top of the sonication cleaning tank 302.

In one embodiment, the overall flow of the liquid 304 through the sonication cleaning tank 302 may be generally parallel to the direction of propagation of the acoustic waves generated by a sonication generator (not shown). However, in other embodiments, a sonication generator may be otherwise oriented, such that the overall flow of the liquid 304 through the sonication cleaning tank 302 is generally perpendicular (or at some other angle) to the direction of propagation of the acoustic waves.

Figure 4:
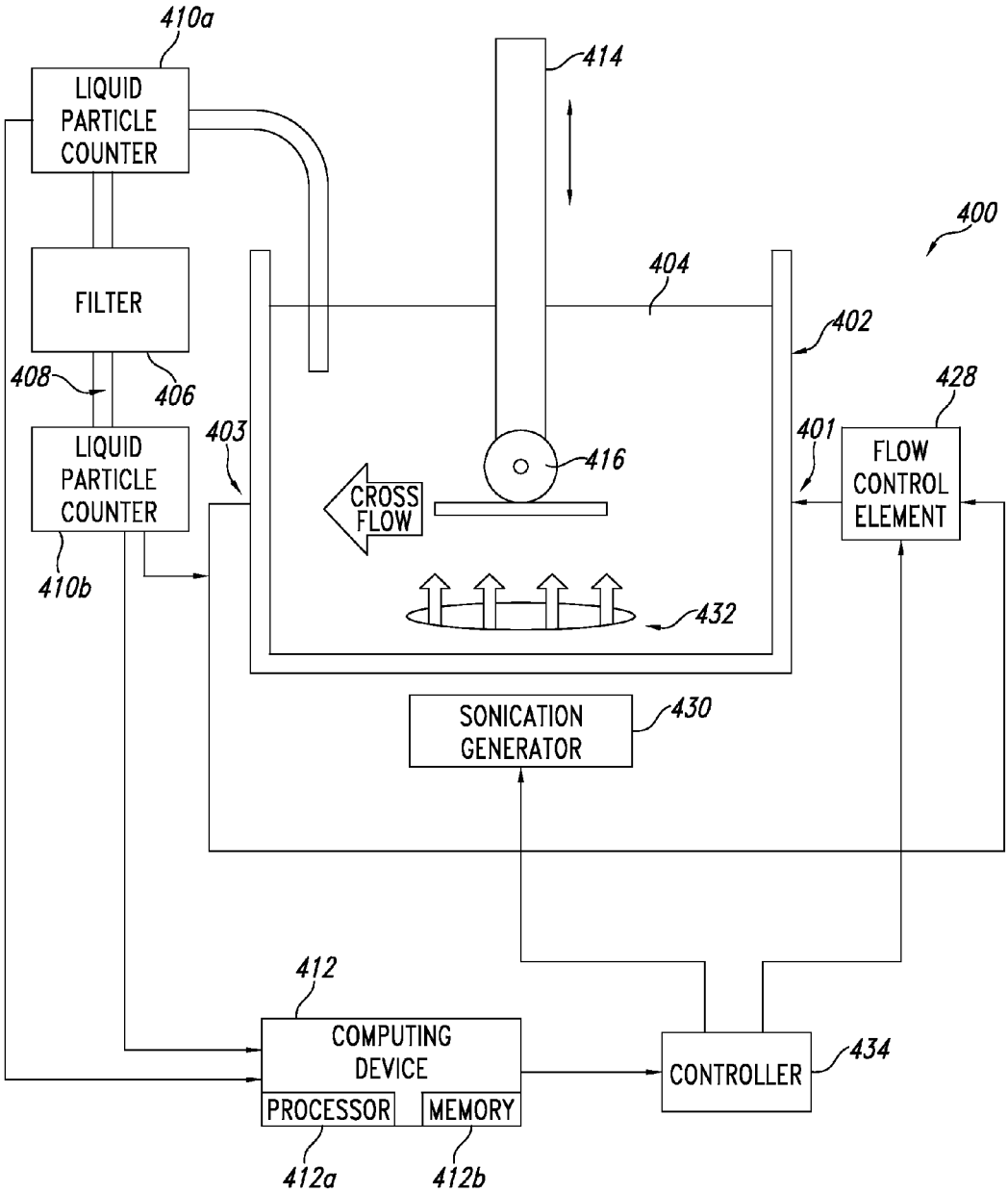
FIG. 4 is a schematic view illustrating an example sonication cleaning system in greater detail, according to one embodiment.

FIG. 4 illustrates yet another sonication cleaning system 400 in greater detail. The sonication cleaning system 400 may be configured similarly to the sonication cleaning system 100, with like numerals referring to like components. Much of the description corresponding to FIG. 1 can be applied equally to the components of FIG. 4. Only the new components and different component arrangements of the sonication cleaning system 400 are discussed in greater detail below.

The sonication cleaning system 400 may include a flow control element 428 fluidly coupled to the sonication cleaning tank 402 via one or more ingress ports 401 and configured to cause the liquid 404 to flow through the sonication cleaning tank 402 from right to left (as illustrated in FIG. 4). The flow control element 428 may comprise a number of hydraulic components. In one embodiment, the flow control element 428 may comprise an electronically controlled proportional valve configured to control a flow rate of the liquid 404 between 0 and 100 liters per minute. The proportional valve may be coupled to a pump (not shown), which may drive the liquid 404 through the sonication cleaning system 400. In other embodiments, other flow control elements, such as servo valves, may be used in order to modulate the flow rate through the sonication cleaning tank 402.

The sonication cleaning tank 402 may further include a perforated side panel (not shown) near the ingress port(s) 401. The perforated side panel may be configured to create a generally laminar cross flow across the sonication cleaning tank 402 (from right to left in FIG. 4). In other embodiments, multiple ingress ports 401 may be used in order to create a generally laminar cross flow.

The sonication cleaning system 400 may further include a sonication generator 430 configured to generate sonication (i.e., acoustic waves) through the liquid 404 within the sonication cleaning tank 402. The sonication generator 430 may generate megasonication, ultrasonication (a lower frequency sonication than megasonication), or acoustic waves at other frequencies. Ultrasonic cleaning may use lower frequencies and thereby produce more random cavitations, while megasonication may use higher frequencies and thereby produce more controlled cavitations.

In one embodiment, the sonication generator 430 may comprise a frequency generator configured to drive one or more sonication transducers (not shown). The sonication transducers may, in turn, generate the acoustic stream 432 emanating from the bottom of the sonication cleaning tank 402. The sonication generator 430 may also be electronically controlled, such that the frequency and/or amplitude of the generated sonication may be varied. For example, the sonication generator 430 may comprise a programmable digital generator having a range of 0 to 800 watts. Although illustrated at the bottom of the sonication cleaning tank 402, the sonication generator 430 and associated transducers may be oriented differently in order to generate acoustic waves traveling in other directions.

As illustrated, the sonication cleaning system 400 includes two liquid particle counters 410*a*, 410*b*. The first liquid particle counter 410*a* may be fluidly coupled to the sonication cleaning tank 402 near one or more egress ports 403. In one embodiment, the first liquid particle counter 410*a* is configured to generate a first opacity count indicative of contaminants and/or bubbles in the liquid 404. The liquid 404 drawn through the first liquid particle counter 410*a* may then flow to the filter 406, which is fluidly coupled thereto. The filter 406 may then remove contaminants from at least some of the liquid 104 to produce filtered liquid 408, which may then flow to the second liquid particle counter 410*b*. In one embodiment, the second liquid particle counter 410*b* is configured to generate a second opacity count indicative of contaminants and/or bubbles in the filtered liquid 408 from the filter 406. The two liquid particle counters 410*a*, 410*b* may correspond to the at least one liquid particle counter 110 discussed at length above with respect to FIG. 1. Of course, other configurations are possible for the liquid particle counters 410*a*, 410*b* and the filter 406.

In one embodiment, both liquid particle counters 410*a*, 410*b* are communicatively coupled to the computing device 412, which may be configured to determine a contaminant count corresponding to an estimated number of contaminants in the liquid 404 based at least in part on the first and second opacity counts. As illustrated, the computing device 412 may comprise a processor 412*a* operable to execute instructions and a computer-readable memory 412*b* having instructions stored thereon that are executable by the processor 412*a* in order to cause the processor 412*a* to perform certain functions (e.g., determining the contaminant count). In different embodiments, the computing device 412 may perform different functions, as described in greater detail below.

The sonication cleaning system 400 may further include a controller 434 coupled to the computing device 412 and configured to control at least one of the flow control element 428 and the sonication generator 430 based on at least one of the first and second opacity counts. The controller 434 may comprise, for example, a programmable logic controller. In one embodiment, the computing device 412 may send signals to the controller 434 based at least in part on the contaminant count, and the controller 434 may, in turn, control at least one of the flow control element 428 and the sonication generator 430 based at least in part on those signals. For example, if the contaminant count is relatively high, the controller 434 may cause the flow control element 428 to increase flow through the sonication cleaning tank 402 in order to "flush" the contaminants out more quickly, and/or the controller 434 may cause the sonication generator 430 to decrease power in order to slow down the generation of additional contaminants. In some embodiments, the computing device 412 and the controller 434 may be configured to control the flow control element 428 and the sonication generator 430 based on one or more control algorithms.

Figure 5:
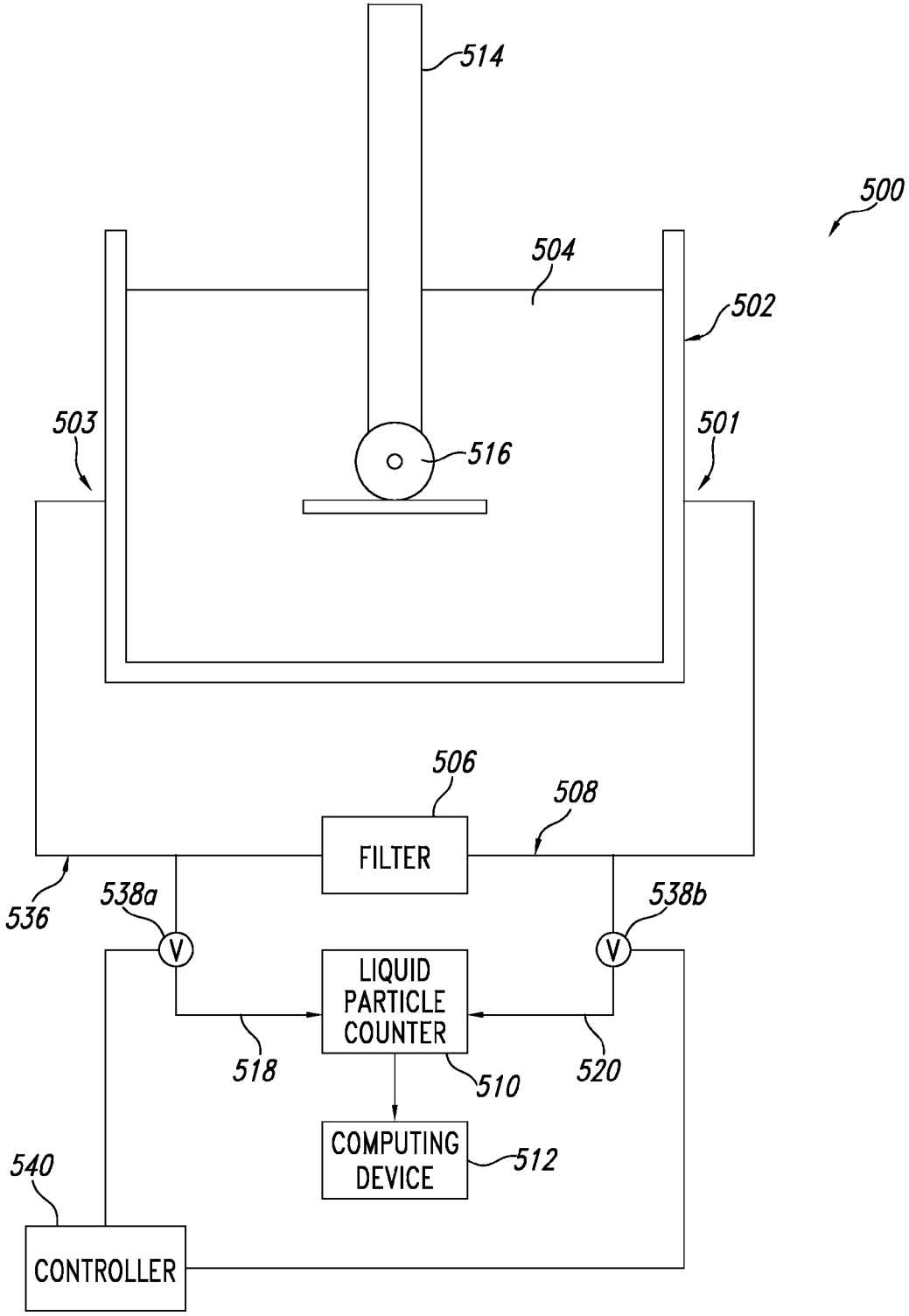
FIG. 5 is a schematic view illustrating another example sonication cleaning system including a filter and a liquid particle counter, according to one embodiment.

FIG. 5 illustrates a sonication cleaning system 500 configured similarly to the sonication cleaning system 100, with like numerals referring to like components. Much of the description corresponding to FIG. 1 can be applied equally to the components of FIG. 5. Only the new components and different component arrangements of the sonication cleaning system 500 are discussed in greater detail below.

As illustrated, the sonication cleaning system 500 includes a recirculation loop 536 extending between one or more egress ports 503 and one or more ingress ports 501 of the sonication cleaning tank 502. Positioned along this recirculation loop 536, the filter 506 may be configured to remove contaminants washed away from the disk 516 before the liquid 504 is reintroduced into the sonication cleaning tank 502.

In one embodiment, at least two proportional valves 538*a*, *b* may be included in the sonication cleaning system 500. A first proportional valve 538*a* may be positioned between the sonication cleaning tank 502 and the liquid particle counter 510, and a second proportional valve 538*b* may be positioned between the filter 506 and the liquid particle counter 510. In one embodiment, the liquid particle counter 510 may drain liquid passing therethrough away from the recirculation loop 536, while, in another embodiment, the proportional valves 538*a, b* may comprise two-way valves, such that when a proportional valve 538 is "closed," liquid might still pass through in one direction.

The proportional valves 538*a, b* may be manually operated. However, in other embodiments, a controller 540 (e.g., a programmable logic controller) may be coupled to and configured to control the first and second proportional valves 538*a, b*. The controller 540 may be configured to open the first proportional valve 538*a* and close the second proportional valve 538*b* in order to generate the first opacity count, and configured to close the first proportional valve 538*a* and open the second proportional valve 538*b* in order to generate the second opacity count. The controller 540 may also be communicatively coupled to a computing device (which may be the computing device 512 or another computing device), which may cause the controller 540 to open and close the proportional valves 538*a, b* according to a defined control algorithm.

As illustrated, the same liquid particle counter 510 may be used to generate opacity counts corresponding to both the liquid 504 and the filtered liquid 508. In one embodiment, the computing device 512 may be configured to determine a filter efficiency based at least in part on the first and second opacity counts. The filter efficiency may be determined by the computing device 512 in a variety of ways. In one embodiment, the filter efficiency may be determined by introducing a known quantity of contaminants into the liquid 504, and then comparing the known quantity of contaminants against the contaminant count determined based on the first and second opacity counts. The difference between the known quantity of contaminants and the contaminant count may be indicative of the filter efficiency. In another embodiment, historical averages of the first and second opacity counts may be used to determine an approximate filter efficiency based on relatively predictable contaminant and bubble levels produced during cleaning operations.

The computing device 512 may then compare the filter efficiency against a filter efficiency threshold, and trigger an alarm based at least in part on the comparison. The filter efficiency threshold may be defined by a user and stored on the computing device 512, and the threshold may correspond to a filter efficiency below which the filter 506 is no longer suitable for the cleaning operations of the sonication cleaning system 500. If the filter efficiency drops below the filter efficiency threshold, the alarm may alert an operator that the filter 506 should be changed. In one embodiment, the cleaning operations may also be halted based upon the alarm. Thus, the sonication cleaning system 500 may enable an operator to monitor the health of the filter 506 and replace it at appropriate intervals.

Figure 6:
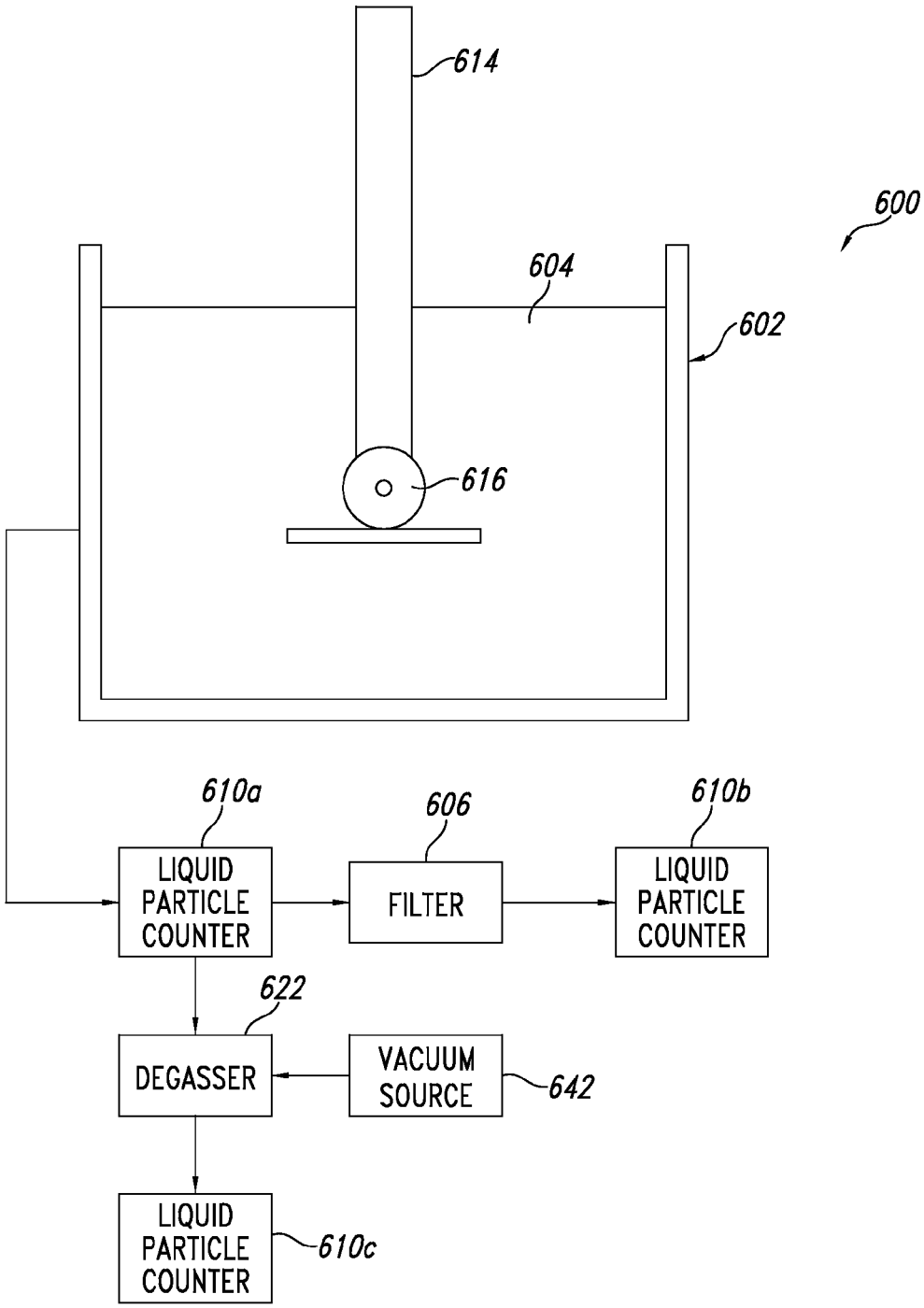
FIG. 6 is a schematic view illustrating an example sonication cleaning system including a filter, a degasser and multiple liquid particle counters, according to one embodiment.

FIG. 6 illustrates a sonication cleaning system 600 configured similarly to the sonication cleaning system 200, with like numerals referring to like components. Much of the description corresponding to FIGS. 1 and 2 can be applied equally to the components of FIG. 6. Only the new components and different component arrangements of the sonication cleaning system 600 are discussed in greater detail below.

In one embodiment, the sonication cleaning system 600 includes a plurality of liquid particle counters 610*a, b, c* fluidly coupled to the sonication cleaning tank 602, the filter 606 and the degasser 622. In particular, a first liquid particle counter 610*a* may be fluidly coupled to the sonication cleaning tank 602 and configured to generate a first opacity count. A second liquid particle counter 610*b* may be fluidly coupled to the filter 606 and configured to generate a second opacity count. A third liquid particle counter 610*c* may be fluidly coupled to the degasser 622 and configured to generate the third opacity count. These liquid particle counters 610*a, b, c* may be of the same general configuration or may be differently configured. Thus, in one embodiment, rather than having a system of proportional valves and a single liquid particle counter, multiple liquid particle counters 610*a, b, c* may be employed. In one embodiment, the three liquid particle counters 610*a, b, c* may be communicatively coupled to a computing device (not shown).

In one embodiment, the degasser 622 is coupled to a vacuum source 642, as described above. The vacuum source 642 may comprise, for example, a venturi vacuum, a pump vacuum or some other vacuum generation apparatus.

Figure 7:
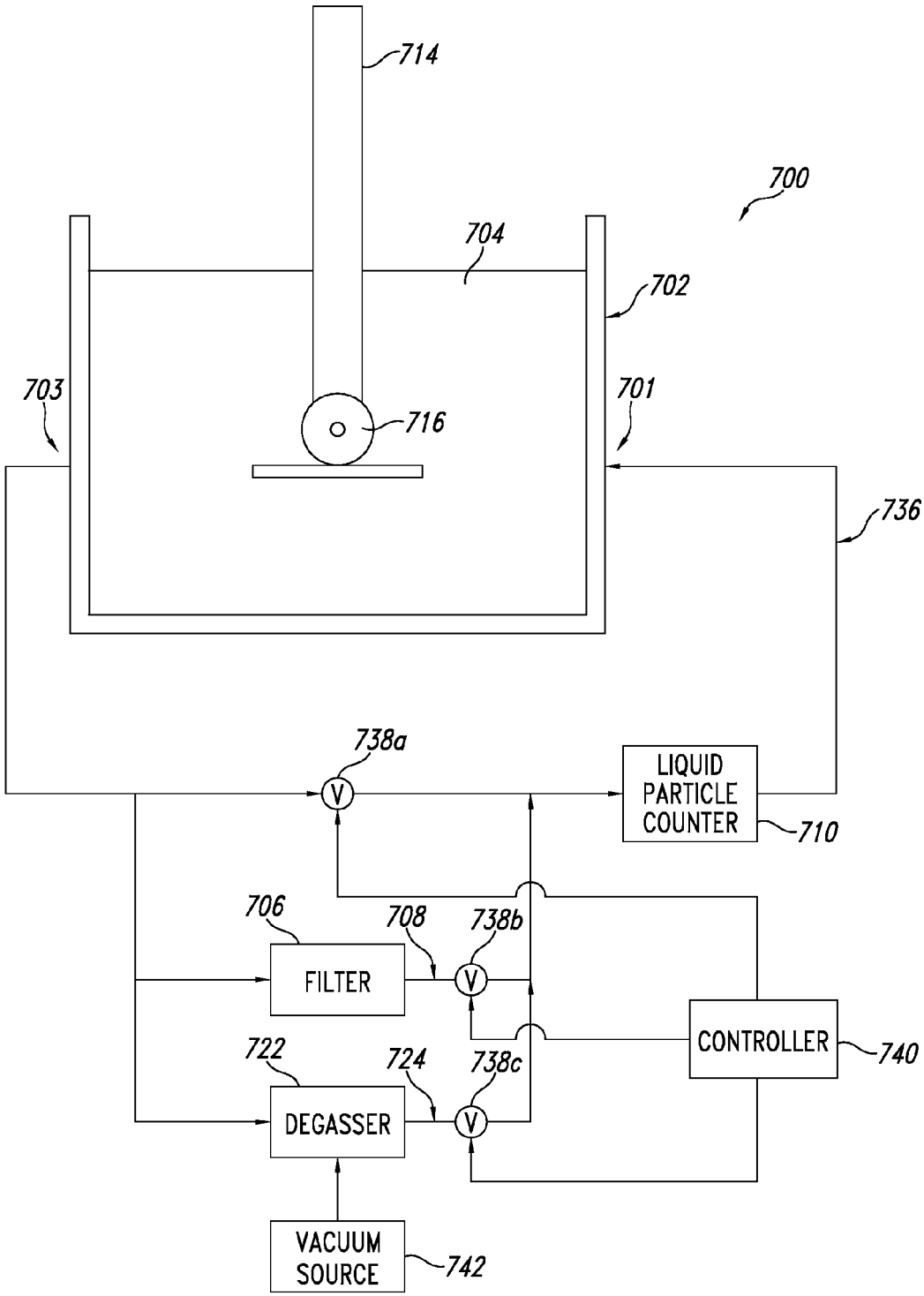
FIG. 7 is a schematic view illustrating an example sonication cleaning system including a filter, a degasser, and one liquid particle counter coupled to both the filter and the degasser, according to one embodiment.

FIG. 7 illustrates a sonication cleaning system 700 configured similarly to the sonication cleaning system 200, with like numerals referring to like components. Much of the description corresponding to FIGS. 1 and 2 can be applied equally to the components of FIG. 7. Only the new components and different component arrangements of the sonication cleaning system 700 are discussed in greater detail below.

As illustrated, the sonication cleaning system 700 includes a recirculation loop 736 extending between one or more egress ports 703 and one or more ingress ports 701 of the sonication cleaning tank 702. In one embodiment, a liquid particle counter 710 is positioned along this recirculation loop 736. The liquid particle counter 710 may be fluidly coupled to the sonication cleaning tank 702, the filter 706 and the degasser 722, and may be configured to generate the first opacity count, the second opacity count and the third opacity count.

In one embodiment, the sonication cleaning system 700 may further include at least three proportional valves 738*a, b, c*. A first proportional valve 738*a* may be positioned between the sonication cleaning tank 702 and the liquid particle counter 710. A second proportional valve 738*b* may be positioned between the filter 706 and the liquid particle counter 710. A third proportional valve 738*c* may be positioned between the degasser 722 and the liquid particle counter 710.

In one embodiment, the proportional valves 738*a, b, c* may be manually operated. However, in other embodiments, a controller 740 may be coupled to the proportional valves 738*a, b, c*. The controller 540 may be configured to open the first proportional valve 738*a* and close the second and third proportional valves 738*b, c* in order to generate the first opacity count, to open the second proportional valve 738*b* and close the first and third proportional valves 738*a, c* in order to generate the second opacity count, and to open the third proportional valve 738*c* and close the first and second proportional valves 738*a, b* in order to generate the third opacity count. Of course, in other embodiments, other valve configurations may be used to allow the liquid 704 to flow between the various components of the sonication cleaning system 700.

Figure 8:
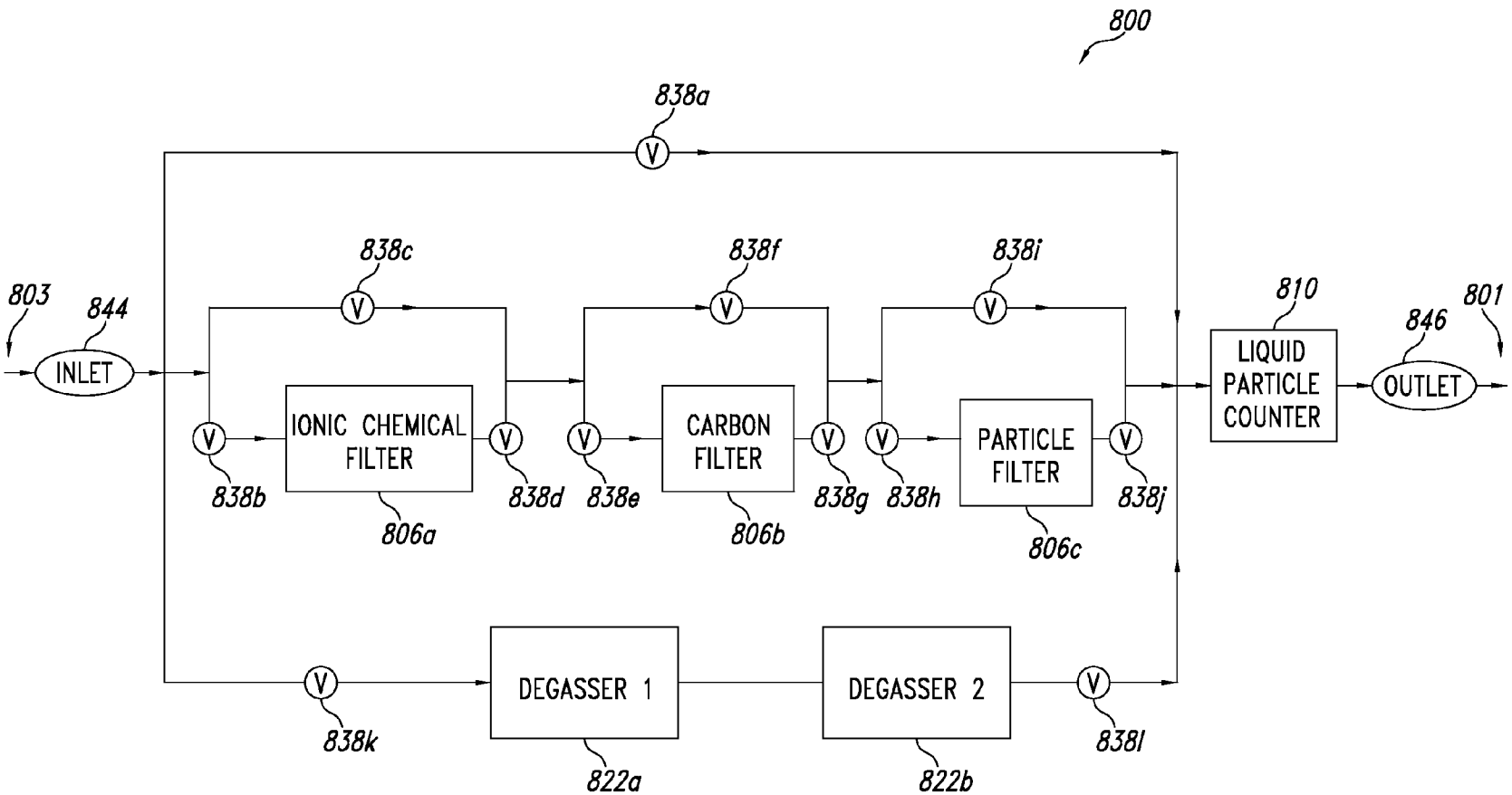
FIG. 8 is a schematic view illustrating a portion of an example sonication cleaning system including multiple filters and multiple degassers, according to one embodiment.

FIG. 8 illustrates yet another sonication cleaning system 800, in which the sonication cleaning tank has been omitted for clarity. As illustrated, the inlet 844 is coupled to an egress port 803 of the sonication cleaning tank, and the outlet 846 is coupled to an ingress port 801 of the sonication cleaning tank. The inlet 844 and outlet 846 denote a logical inlet and outlet for fluid flowing through the portion of the sonication cleaning system 800 illustrated in FIG. 8, and may, for example, simply comprise piping. The sonication cleaning system 800 may be configured similarly to the sonication cleaning system 200, with like numerals referring to like components. Much of the description corresponding to FIGS. 1 and 2 can be applied equally to the components of FIG. 8. Only the new components and different component arrangements of the sonication cleaning system 800 are discussed in greater detail below.

The sonication cleaning system 800 may include multiple filters 806*a, b, c*. A first filter 806*a* may be configured to remove a first type of contaminants from at least some of the liquid in the sonication cleaning tank to produce filtered liquid. A second filter 806*b* may be configured to remove a second type of contaminants from at least some of the liquid to produce filtered liquid. A third filter 806*c* may be configured to remove a third type of contaminants from at least some of the liquid to produce filtered liquid. The different filters 806 may remove a variety of contaminants. In one embodiment, the first filter 806*a* comprises an ionic chemical filter configured to remove ionic chemicals, the second filter 806*b* comprises a carbon filter configured to remove contaminants that react with the carbon (e.g., volatile organic compounds), and the third filter 806*c* comprises a particle filter (e.g., a paper filter) configured to remove particles above a certain minimum size. Of course, in other embodiments, any combination or sub-combination of the illustrated filters may be arranged in any order. Indeed, in some embodiments, a different set of filters may be used (including one or more of the same filters coupled in series or parallel). Each of the filters 806*a, b, c* may be fluidly coupled to the sonication cleaning tank and to the liquid particle counter 810.

The liquid particle counter 810 may be configured to generate a number of opacity counts corresponding to unfiltered, filtered and degassed liquids produced within the sonication cleaning system 800. In one embodiment, the liquid particle counter 810 is configured to generate a first opacity count indicative of contaminants and/or bubbles in the liquid (unfiltered by any of the filters 806), a second opacity count indicative of contaminants and/or bubbles in the liquid filtered using the first filter 806*a*, a third opacity count indicative of contaminants and/or bubbles in the liquid filtered using the second filter 806*b*, a fourth opacity count indicative of contaminants and/or bubbles in the liquid filtered using the third filter 806*c* and a fifth opacity count indicative of contaminants and/or bubbles in the liquid degassed by the degassers 822*a, b* coupled in series. The liquid particle counter 810 may also be configured to generate only a subset of the above opacity counts.

In other embodiments, the liquid particle counter 810 may also generate opacity counts indicative of contaminants and/or bubbles in liquid that has passed through more than one of the filters 806*a, b, c*. For example, the liquid particle counter 810 may be configured to generate a total filtered opacity count indicative of contaminants and/or bubbles in liquid filtered using all three filters 806*a, b, c*.

A computing device (not shown) may be coupled to the liquid particle counter 810 as discussed at length above. The computing device may be configured to generate a first contaminant count corresponding to an estimated number of the first type of contaminants (e.g., ionic chemicals) based at least in part on the first and second opacity counts, a second contaminant count corresponding to an estimated number of the second type of contaminants (e.g., contaminants that react with the carbon) based at least in part on the first and third opacity counts, and a third contaminant count corresponding to an estimated number of the third type of contaminants (e.g., particles in a certain size range) based at least in part on the first and fourth opacity counts. The computing device may be further configured to determine a degassing efficiency associated with the degassers 822*a, b* based at least in part on the first opacity count, the fifth opacity count and the total filtered opacity count.

As illustrated, the sonication cleaning system 800 may also include a plurality of proportional valves 838*a-l*. The proportional valves 838 may be positioned between the sonication cleaning tank (not shown), the first filter 806*a*, the second filter 806*b*, the third filter 806*c*, the degassers 822*a, b*, and the liquid particle counter 810. In one embodiment, the proportional valves 838 may be manually operated. However, in other embodiments, a controller (not shown) may be coupled to and configured to control the plurality of proportional valves 838. The controller may be configured to control the plurality of proportional valves 838 in order to generate the first opacity count, the second opacity count, the third opacity count, the fourth opacity count, the fifth opacity count, and the total filtered opacity count. For example, the first opacity count may be generated by controlling the plurality of proportional valves 838 to allow at least some of the liquid to flow from the sonication cleaning tank through the liquid particle counter 810. The second opacity count may be generated by controlling the plurality of proportional valves 838 to allow at least some of the liquid filtered using the first filter 806*a* to flow from the first filter 806*a* through the liquid particle counter 810. The third opacity count may be generated by controlling the plurality of proportional valves 838 to allow at least some of the liquid filtered using the second filter 806*b* to flow from the second filter 806*b* through the liquid particle counter 810. The fourth opacity count may be generated by controlling the plurality of proportional valves 838 to allow at least some of the liquid filtered using the third filter 806*c* to flow from the third filter 806*c* through the liquid particle counter 810. The fifth opacity count may be generated by controlling the plurality of proportional valves 838 to allow at least some of the liquid degassed using the degassers 822*a, b* to flow from the degasser 822*b* through the liquid particle counter 810. The total filtered opacity count may be generated by controlling the plurality of proportional valves 838 to allow at least some of the liquid filtered using all of the filters 806*a-c* to flow from the third filter 806*c* through the liquid particle counter 810. Of course, in other embodiments, different valve configurations may be used to control the flow of liquid between the components of the sonication cleaning system 800.

Figure 9:
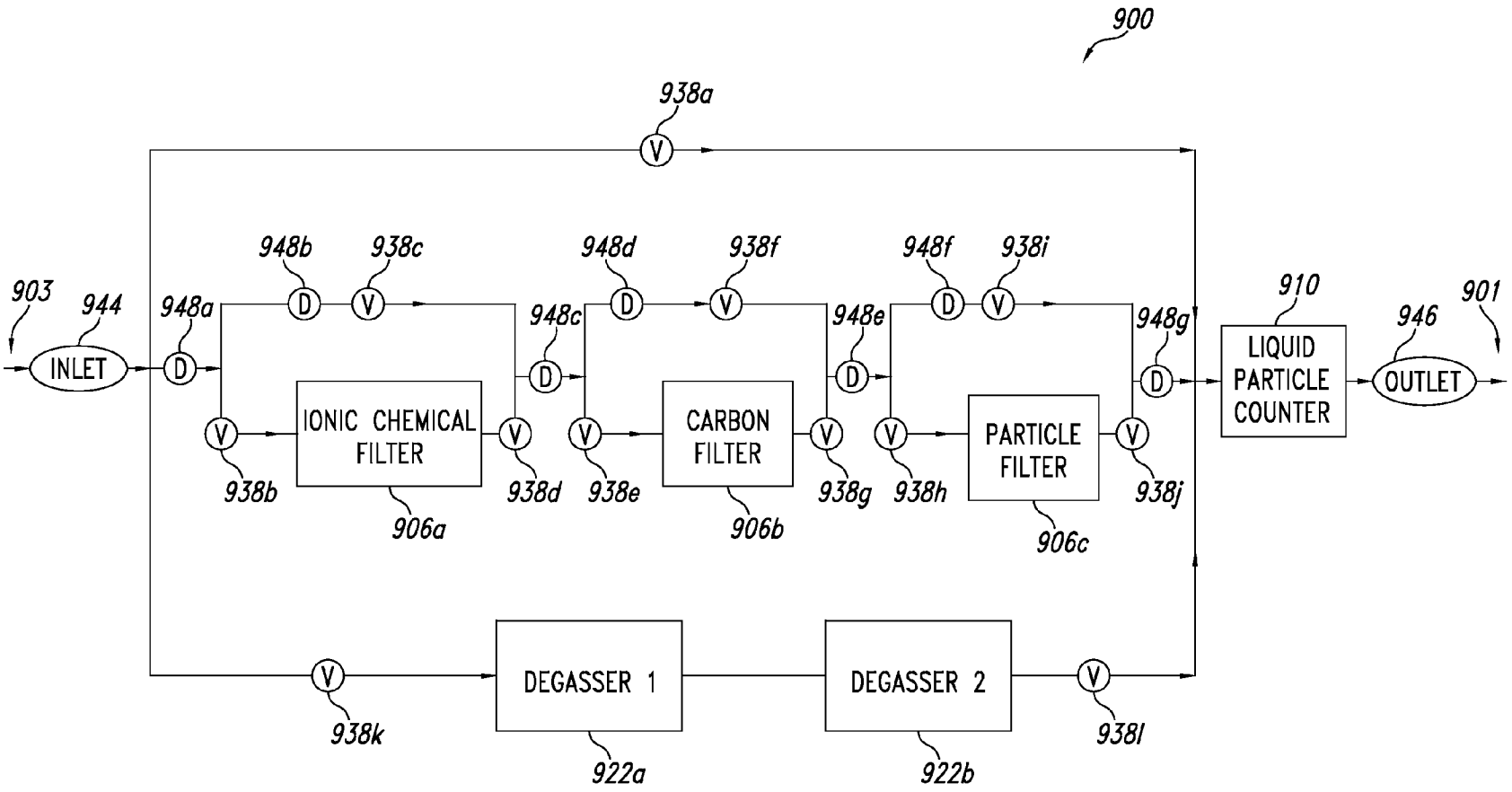
FIG. 9 is a schematic view illustrating a portion of another example sonication cleaning system including multiple filters and multiple degassers, according to one embodiment.

FIG. 9 illustrates another sonication cleaning system 900, in which the sonication cleaning tank has been omitted for clarity. The sonication cleaning system 900 may be configured similarly to the sonication cleaning system 800, with like numerals referring to like components. Much of the description corresponding to FIGS. 1, 2 and 8 can be applied equally to the components of FIG. 9. Only the new components and different component arrangements of the sonication cleaning system 900 are discussed in greater detail below.

The sonication cleaning system 900 may include a plurality of degassers 948*a-g* associated with the plurality of filters 906*a, b, c*, and separated from the degassers 922*a, b*. Each of these degassers 948 may be configured similarly to the degassers 922, and may be configured to degas the liquid passing therethrough. Of course, in other embodiments, the degassers may be configured differently from the degassers 922.

Figure 10:
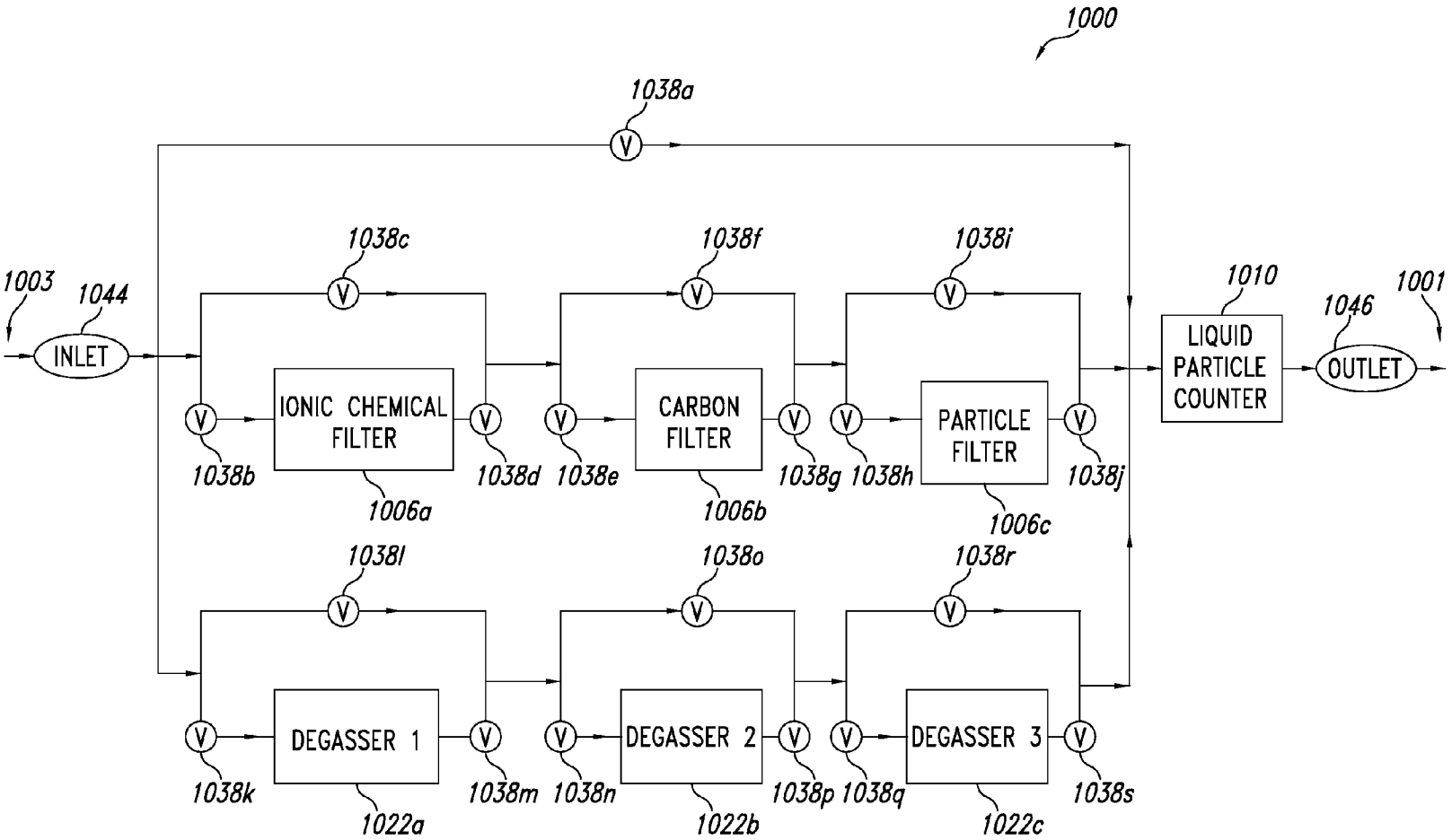
FIG. 10 is a schematic view illustrating a portion of yet another example sonication cleaning system including multiple filters and multiple degassers, according to one embodiment.

FIG. 10 illustrates still another sonication cleaning system 1000, in which the sonication cleaning tank has been omitted for clarity. The sonication cleaning system 1000 may be configured similarly to the sonication cleaning system 800, with like numerals referring to like components. Much of the description corresponding to FIGS. 1, 2 and 8 can be applied equally to the components of FIG. 10. Only the new components and different component arrangements of the sonication cleaning system 1000 are discussed in greater detail below.

As illustrated, the sonication cleaning system 1000 includes a plurality of degassers 1022. Each of the degassers 1022*a, b, c* is fluidly coupled to the sonication cleaning tank and configured to remove bubbles from at least some of the liquid to produce degassed liquid. In one embodiment, each of the degassers 1022*a, b, c* may be similarly configured. However, in other embodiments, different degassers may be used.

The liquid particle counter 1010 may be configured to generate a number of opacity counts corresponding to unfiltered, filtered and degassed liquids produced within the sonication cleaning system 1000. In one embodiment, the liquid particle counter 1010 is configured to generate a first opacity count indicative of contaminants and/or bubbles in the liquid, a second opacity count indicative of contaminants and/or bubbles in the liquid filtered using one or more of the filters 1006, a third opacity count indicative of contaminants and/or bubbles in the liquid degassed using a first degasser 1022*a*, a fourth opacity count indicative of contaminants and/or bubbles in the liquid degassed using a second degasser 1022*b*, and a fifth opacity count indicative of contaminants and/or bubbles in the liquid degassed using a third degasser 1022*c*.

In some embodiments, the liquid particle counter 1010 may also generate opacity counts indicative of contaminants and/or bubbles in liquid that has passed through more than one of the degassers 1022*a-c*. For example, the liquid particle counter 1010 may be configured to generate a total degassed opacity count indicative of contaminants and/or bubbles in liquid degassed using all three degassers 1022*a-c*.

A computing device (not shown) may be coupled to the liquid particle counter 1010 as discussed at length above. The computing device may be configured to generate a contaminant count corresponding to an estimated number of contaminants based at least in part on the first and second opacity counts, a first degassing efficiency associated with the first degasser 1022*a* based at least in part on the first, second and third opacity counts, a second degassing efficiency associated with the second degasser 1022*b* based at least in part on the first, second and fourth opacity counts, and a third degassing efficiency associated with the third degasser 1022*c* based at least in part on the first, second and fifth opacity counts. In one embodiment, the computing device may be further configured to generate a total degassing efficiency associated with all of the degassers 1022*a-c* based at least in part on the first opacity count, the second opacity count and the total degassed opacity count.

As illustrated, the sonication cleaning system 1000 may include a plurality of proportional valves 1038*a-s*. The proportional valves 1038 may be positioned between the sonication cleaning tank (not shown), the filters 1006*a-c*, the degassers 1022*a-c* and the liquid particle counter 1010. In one embodiment, the proportional valves 1038 may be manually operated. However, in other embodiments, a controller (not shown) may be coupled to and configured to control the plurality of proportional valves 1038. The controller may be configured to control the plurality of proportional valves 1038 in order to generate the first opacity count, the second opacity count, the third opacity count, the fourth opacity count, the fifth opacity count, and the total degassed opacity count. For example, the first opacity count may be generated by controlling the plurality of proportional valves 1038 to allow at least some of the liquid to flow from the sonication cleaning tank through the liquid particle counter 1010. The second opacity count may be generated by controlling the plurality of proportional valves 1038 to allow at least some filtered liquid to flow from one or more of the filters 1006 through the liquid particle counter 1010. The third opacity count may be generated by controlling the plurality of proportional valves 1038 to allow at least some of the liquid degassed using the first degasser 1022*a* to flow from the first degasser 1022*a* through the liquid particle counter 1010. The fourth opacity count may be generated by controlling the plurality of proportional valves 1038 to allow at least some of the liquid degassed using the second degasser 1022*b* to flow from the second degasser 1022*b* through the liquid particle counter 1010. The fifth opacity count may be generated by controlling the plurality of proportional valves 1038 to allow at least some of the liquid degassed using the third degasser 1022*c* to flow from the third degasser 1022*c* through the liquid particle counter 1010. The total degassed opacity count may be generated by controlling the plurality of proportional valves 1038 to allow at least some of the liquid degassed using all of the degassers 1022*a-c* to flow from the third degasser 1022*c* through the liquid particle counter 1010. Of course, in other embodiments, other valve configurations may be used to control the flow of liquid between the components of the sonication cleaning system 1000.

Figure 11:
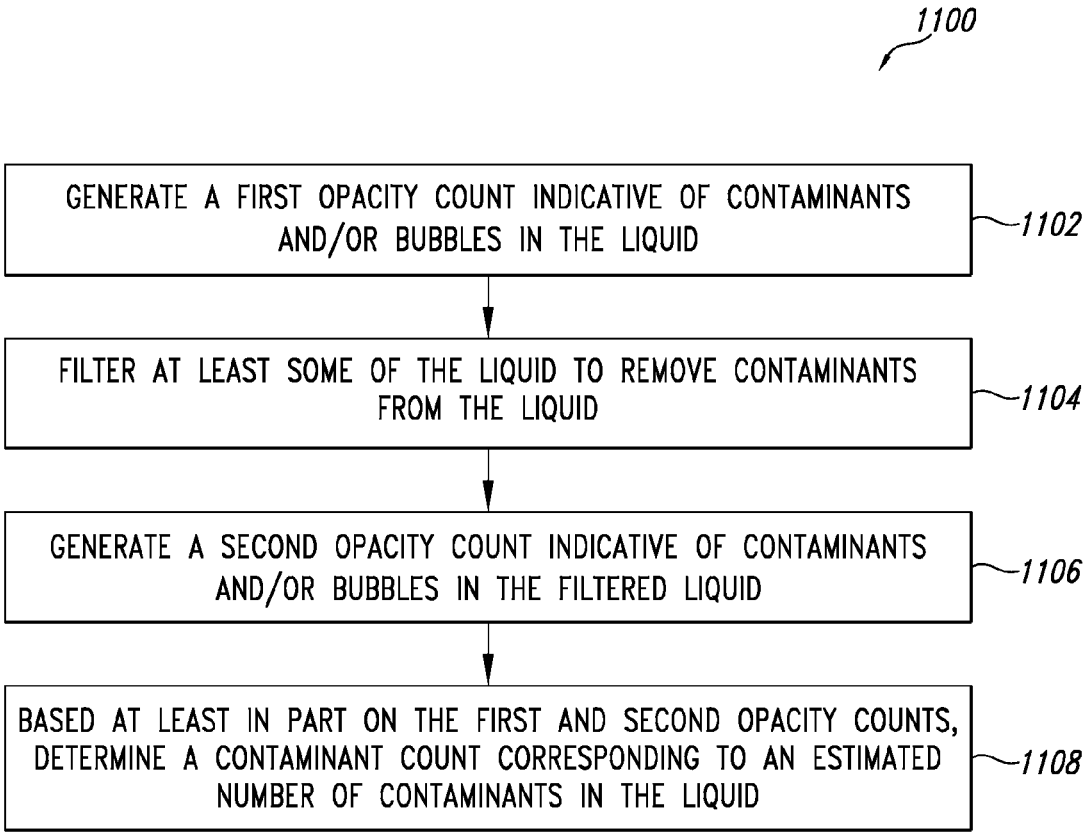
FIG. 11 illustrates a flow chart for monitoring a sonication cleaning tank, according to one embodiment.

FIG. 11 illustrates a flow chart for a method 1100 of monitoring a sonication cleaning tank containing a liquid, according to one illustrated embodiment. This method 1100 will be discussed primarily in the context of the sonication cleaning system 100 of FIG. 1. However, the acts described below may be performed using a variety of sonication cleaning systems (including the systems illustrated in FIGS. 2-10), in accordance with the described method. In one embodiment, the method 1100 is executed during the manufacture of disks or other workpieces. In other embodiments, the method 1100 is executed during other engineering or testing processes independent of a manufacturing process.

As described herein, many of the acts comprising the method 1100 may be orchestrated by a computing device 112, and, in particular, by a processor based at least in part on computer-readable instructions stored in computer-readable memory and executable by the processor. Of course, a manual implementation of one or more acts of the method 1100 may also be employed.

At act 1102, a first opacity count indicative of contaminants and/or bubbles in the liquid 104 is generated. As described in greater detail above, the first opacity count may be generated by passing at least some of the liquid 104 from the sonication cleaning tank 102 through a liquid particle counter 110 including a light sensor configured to generate signals indicative of the first opacity count.

In one embodiment, the first opacity count is generated while a cleaning operation is being carried out. For example, a disk 116 may first be placed into the sonication cleaning tank 102. The disk 116 may be lowered in a disk holder 114 movable between raised and lowered positions. The entire disk 116 may be submerged, as illustrated in FIG. 1, or, in other embodiments, only a portion of the disk 116 may be submerged. The disk 116 may then be cleaned within the sonication cleaning tank 102 (e.g., by applying a flow rate and a sonication power to the liquid 104). Without interrupting this cleaning operation, at least some of the liquid 104 may concurrently pass through the liquid particle counter 110 to generate the first opacity count.

At act 1104, at least some of the liquid 104 is filtered to remove contaminants from the liquid 104. As described in greater detail above, at least some of the liquid 104 may pass through one or more filters 106 configured to remove contaminants therefrom. A variety of different filters may be used in order to remove various contaminants from the liquid 104.

At act 1106, a second opacity count indicative of contaminants and/or bubbles in the filtered liquid 108 is generated.

The second opacity count may be generated in a manner similar to that employed at act 1102. That is, the filtered liquid 108 may be passed through a liquid particle counter 110. In some embodiments, a single liquid particle counter 110 may be used to generate both the first and the second opacity counts, using, for example, a system of valves. In other embodiments, multiple liquid particle counters may be positioned in the sonication cleaning system 100 in order to generate the different opacity counts (as illustrated in FIG. 6).

As illustrated in FIG. 5, in one embodiment, generating the first opacity count includes controlling a first proportional valve 538*a* to allow the liquid 504 to flow from the sonication cleaning tank 502 through the liquid particle counter 510, and generating the second opacity count includes controlling a second proportional valve 538*b* to allow the filtered liquid 508 to flow from the filter 506 through the liquid particle counter 510. A controller 540 may be used to control the proportional valves 538*a, b* in order to generate the respective opacity counts.

At act 1108, based at least in part on the first and second opacity counts, a contaminant count corresponding to an estimated number of contaminants in the liquid 104 may be determined. The contaminant count may be determined by a computing device 112 coupled to the at least one liquid particle counter 110. In one embodiment, the contaminant count is equal to the second opacity count subtracted from the first opacity count. Of course, the computing device 112 may also take into account other variables when calculating the contaminant count, as described at length above.

As illustrated in FIG. 4, at least one of a flow rate and a sonication power applied to the liquid 404 may be controlled based on at least one of the first and second opacity counts. For example, the computing device 412 may send commands to a controller 434 to adjust at least one of the flow rate and sonication power based on at least one of the first and second opacity counts. For example, if the contaminant count is relatively high, the controller 434 may cause a flow control element 428 to increase flow through the sonication cleaning tank 402 in order to "flush" the contaminants out more quickly, and/or the controller 434 may cause a sonication generator 430 to decrease power in order to slow down the generation of additional contaminants. Of course, in other embodiments, the flow rate and the sonication power may be controlled in a number of ways in response to the first and second opacity counts.

In another embodiment, as illustrated in FIG. 2, at least some of the liquid 204 may be degassed in order to remove bubbles from the liquid 204. A third opacity count indicative of contaminants and/or bubbles in the degassed liquid 224 may be generated, and, based at least in part on the first, second and third opacity counts, a degassing efficiency associated with degassing the at least some of the liquid 204 may be determined. In one embodiment, at least one degasser 222 may be used to degas the liquid, and the degassing efficiency associated with the at least one degasser 222 may be determined by a computing device 212 as described at length above.

Each of the first opacity count, the second opacity count and the third opacity count may be generated at least once every ten seconds. That is, the computing device 212 and the at least one liquid particle counter 210 may generate an opacity count measurement for each of the first, second and third opacity counts at least once every ten seconds. Indeed, in one embodiment, each of the first, second and third opacity counts may be generated at least once every six seconds. In such an embodiment, changes in the contaminant count and degassing efficiency of the sonication cleaning system 200 may be detected rapidly, and appropriate corrective actions may be taken.

The foregoing detailed description has set forth various embodiments of the systems and/or processes via the use of block diagrams, schematics, and examples. Insofar as such block diagrams, schematics, and examples contain one or more functions and/or operations, each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, the embodiments disclosed herein, in whole or in part, can be equivalently implemented in standard integrated circuits, as one or more programs executed by one or more processors, as one or more programs executed by one or more controllers (e.g., microcontrollers), as firmware, or as virtually any combination thereof.

We claim:

1. A sonication cleaning system comprising:

a sonication cleaning tank configured to contain a liquid comprising both contaminants and bubbles;

a filter fluidly coupled to the sonication cleaning tank and configured to remove contaminants from at least some of the liquid to produce filtered liquid;

at least one liquid particle counter fluidly coupled to the sonication cleaning tank, the at least one liquid particle counter configured to generate a first opacity count indicative of both the contaminants and the bubbles in the liquid and further configured to generate a second opacity count indicative of substantially only the bubbles in the filtered liquid; and a computing device coupled to the at least one liquid particle counter and configured to determine a contaminant count corresponding to an estimated number of contaminants in the liquid based at least in part on the first and second opacity counts.

2. The sonication cleaning system of claim 1, further comprising a disk holder configured to hold a disk within the liquid during a cleaning operation.

3. The sonication cleaning system of claim 1, wherein the contaminant count is equal to the second opacity count subtracted from the first opacity count.

4. The sonication cleaning system of claim 1, wherein the computing device includes:

a processor operable to execute instructions; and a computer-readable memory having instructions stored thereon that are executable by the processor in order to cause the processor to:

determine a filter efficiency based at least in part on the first and second opacity counts;

compare the filter efficiency against a filter efficiency threshold; and trigger an alarm based at least in part on the comparison.

5. The sonication cleaning system of claim 1, further comprising:

a flow control element coupled to the sonication cleaning tank and configured to cause at least some of the liquid to flow through the sonication cleaning tank;

a sonication generator configured to generate sonication through the liquid within the sonication cleaning tank; and a controller coupled to the computing device and configured to control at least one of the flow control element and the sonication generator based on at least one of the first and second opacity counts.

6. The sonication cleaning system of claim 1, wherein the at least one liquid particle counter includes a light sensor configured to generate signals indicative of opacity counts.

7. The sonication cleaning system of claim 6, wherein the at least one liquid particle counter is fluidly coupled near an egress port of the sonication cleaning tank and is configured to generate the first opacity count during a cleaning operation.

8. The sonication cleaning system of claim 1, wherein the at least one liquid particle counter includes a first liquid particle counter fluidly coupled to both the sonication cleaning tank and the filter, the first liquid particle counter configured to generate both the first opacity count and the second opacity count.

9. The sonication cleaning system of claim 1, wherein the at least one liquid particle counter includes a first liquid particle counter fluidly coupled to the sonication cleaning tank and configured to generate the first opacity count, and a second liquid particle counter fluidly coupled to the filter and configured to generate the second opacity count.

10. The sonication cleaning system of claim 1, wherein the computing device is configured to calculate a difference between the first opacity count and the second opacity count to determine the contaminant count corresponding to the estimated number of contaminants in the liquid.

11. The sonication cleaning system of claim 1, wherein the filter is positioned between the sonication cleaning tank and the at least one liquid particle counter.

12. The sonication cleaning system of claim 1, wherein the sonication cleaning tank is the only tank in the sonication cleaning system.

13. The sonication cleaning system of claim 1, wherein the filter is configured to receive the liquid directly from the sonication cleaning tank.

14. The sonication cleaning system of claim 1, wherein the at least one liquid particle counter comprises a first liquid particle counter and a second liquid particle counter, wherein the first liquid particle counter is configured to receive the liquid directly from the sonication cleaning tank, wherein the filter is configured to receive the liquid directly from the first liquid particle counter.

15. The sonication cleaning system of claim 14, wherein the second liquid particle counter is configured to receive liquid directly from the filter.

16. A sonication cleaning system comprising:

a sonication cleaning tank configured to contain a liquid;

a filter fluidly coupled to the sonication cleaning tank and configured to remove contaminants from at least some of the liquid to produce filtered liquid;

at least one liquid particle counter fluidly coupled to the sonication cleaning tank, the at least one liquid particle counter configured to generate a first opacity count indicative of contaminants and/or bubbles in the liquid and further configured to generate a second opacity count indicative of contaminants and/or bubbles in the filtered liquid, wherein the at least one liquid particle counter includes a first liquid particle counter fluidly coupled to both the sonication cleaning tank and the filter, the first liquid particle counter configured to generate both the first opacity count and the second opacity count;

a computing device coupled to the at least one liquid particle counter and configured to determine a contaminant count corresponding to an estimated number of contaminants in the liquid based at least in part on the first and second opacity counts;

a first proportional valve positioned between the sonication cleaning tank and the first liquid particle counter;

a second proportional valve positioned between the filter and the first liquid particle counter; and a controller coupled to the first and second proportional valves, the controller configured to open the first proportional valve and close the second proportional valve in order to generate the first opacity count, and configured to open the second proportional valve and close the first proportional valve in order to generate the second opacity count.

17. A sonication cleaning system comprising:

a sonication cleaning tank configured to contain a liquid;

a filter fluidly coupled to the sonication cleaning tank and configured to remove contaminants from at least some of the liquid to produce filtered liquid;

at least one liquid particle counter fluidly coupled to the sonication cleaning tank, the at least one liquid particle counter configured to generate a first opacity count indicative of contaminants and/or bubbles in the liquid and further configured to generate a second opacity count indicative of contaminants and/or bubbles in the filtered liquid;

a computing device coupled to the at least one liquid particle counter and configured to determine a contaminant count corresponding to an estimated number of contaminants in the liquid based at least in part on the first and second opacity counts; and at least one degasser fluidly coupled to the sonication cleaning tank and configured to remove bubbles from at least some of the liquid to produce degassed liquid;

wherein the at least one liquid particle counter is further configured to generate a third opacity count indicative of contaminants and/or bubbles in the degassed liquid; and wherein the computing device is further configured to determine a degassing efficiency associated with the at least one degasser based at least in part on the first, second and third opacity counts.

18. The sonication cleaning system of claim 17, further comprising:

a second degasser fluidly coupled to the sonication cleaning tank and configured to remove bubbles from at least some of the liquid to produce degassed liquid;

wherein the at least one liquid particle counter is further configured to generate a fourth opacity count indicative of contaminants and/or bubbles in the liquid degassed using the second degasser; and wherein the computing device is further configured to determine a second degassing efficiency associated with the second degasser based at least in part on the first, second and fourth opacity counts.

19. The sonication cleaning system of claim 18, further comprising:

a plurality of proportional valves positioned between the sonication cleaning tank, the at least one degasser, the second degasser, and the at least one liquid particle counter; and a controller coupled to the plurality of proportional valves, the controller configured to control the plurality of proportional valves in order to generate the first opacity count, the third opacity count and the fourth opacity count.

20. The sonication cleaning system of claim 17, wherein the at least one degasser includes at least two degassers connected in series.

21. The sonication cleaning system of claim 17, wherein the degassing efficiency is equal to a numerator divided by a denominator, the numerator equal to the third opacity count subtracted from the first opacity count and the denominator equal to the second opacity count.

22. The sonication cleaning system of claim 17, wherein the at least one liquid particle counter includes a first liquid particle counter fluidly coupled to the sonication cleaning tank, the filter and the degasser, the first liquid particle counter configured to generate the first opacity count, the second opacity count and the third opacity count.

23. The sonication cleaning system of claim 22, further comprising:

a first proportional valve positioned between the sonication cleaning tank and the first liquid particle counter;

a second proportional valve positioned between the filter and the first liquid particle counter;

a third proportional valve positioned between the degasser and the first liquid particle counter; and a controller coupled to the first, second and third proportional valves, the controller configured to open the first proportional valve and close the second and third proportional valves in order to generate the first opacity count, configured to open the second proportional valve and close the first and third proportional valves in order to generate the second opacity count, and configured to open the third proportional valve and close the first and second proportional valves in order to generate the third opacity count.

24. The sonication cleaning system of claim 17, wherein the at least one liquid particle counter includes a first liquid particle counter fluidly coupled to the sonication cleaning tank and configured to generate the first opacity count, a second liquid particle counter fluidly coupled to the filter and configured to generate the second opacity count, and a third liquid particle counter fluidly coupled to the degasser and configured to generate the third opacity count.

25. A sonication cleaning system comprising:

a sonication cleaning tank configured to contain a liquid;

a filter fluidly coupled to the sonication cleaning tank and configured to remove contaminants from at least some of the liquid to produce filtered liquid;

at least one liquid particle counter fluidly coupled to the sonication cleaning tank, the at least one liquid particle counter configured to generate a first opacity count indicative of contaminants and/or bubbles in the liquid and further configured to generate a second opacity count indicative of contaminants and/or bubbles in the filtered liquid;

a computing device coupled to the at least one liquid particle counter and configured to determine a contaminant count corresponding to an estimated number of contaminants in the liquid based at least in part on the first and second opacity counts;

wherein the filter is further configured to remove a first type of contaminants from the liquid, and the contaminant count corresponds to an estimated number of the first type of contaminants in the liquid;

a second filter fluidly coupled to the sonication cleaning tank and configured to remove a second type of contaminants from at least some of the liquid to produce filtered liquid;

wherein the at least one liquid particle counter is further configured to generate a third opacity count indicative of contaminants and/or bubbles in the liquid filtered using the second filter; and wherein the computing device is further configured to determine a second contaminant count corresponding to an estimated number of the second type of contaminants in the liquid based at least in part on the first and third opacity counts.

26. The sonication cleaning system of claim 25, further comprising:

a plurality of proportional valves positioned between the sonication cleaning tank, the filter, the second filter, and the at least one liquid particle counter; and a controller coupled to the plurality of proportional valves, the controller configured to control the plurality of proportional valves in order to generate the first opacity count, the second opacity count and the third opacity count.

* * * * *